US006442367B1

(12) United States Patent
Itami et al.

(10) Patent No.: US 6,442,367 B1
(45) Date of Patent: Aug. 27, 2002

(54) ELECTROPHOTOGRAPHIC IMAGE FORMING METHOD, ELECTROPHOTOGRAPHIC IMAGE FORMING APPARATUS, AND PROCESSING CARTRIDGE

(75) Inventors: Akihiko Itami; Takeo Oshiba; Tomoo Sakimura; Yohko Kitahara; Masahiko Kurachi; Kazuhisa Shida, all of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/584,820

(22) Filed: May 31, 2000

(30) Foreign Application Priority Data

May 31, 1999 (JP) ..... 11-151829

(51) Int. Cl.[7] ..... G03G 21/00

(52) U.S. Cl. ..... 399/349; 399/353; 430/58.2; 430/125

(58) Field of Search ..... 399/349, 353, 399/350; 15/256.51, 256.52; 430/58.2, 66, 125

(56) References Cited

U.S. PATENT DOCUMENTS 5,126,798 A * 6/1992 LeRoy et al. ..... 399/349
5,671,475 A * 9/1997 De Cock et al. ..... 399/347
5,681,679 A * 10/1997 Schank et al. ..... 430/59
6,143,452 A * 11/2000 Sakimura et al. ..... 430/58.2
6,203,962 B1 * 3/2001 Itami et al. ..... 430/125

FOREIGN PATENT DOCUMENTS

JP 6118681 4/1994
JP 9-274417 * 11/1997
JP 11-279274 * 10/1999

* cited by examiner

*Primary Examiner*—Quana M. Grainger
(74) *Attorney, Agent, or Firm*—Bierman, Muserlian and Lucas

(57) ABSTRACT

To provide an electrophotographic image forming method, an electro-photographic image forming apparatus, and a processing cartridge and an electrophotographic photoreceptor to be used therein, by which an electrophotographic image with a high image quality can be stably obtained in a condition of high temperature and high humidity.

In an electrophotographic image forming method including cleaning a toner remained on a photoreceptor by a brush roller and an elastic rubber blade after transferring a toner image formed on the photoreceptor to an image receiving material, wherein the photoreceptor has a resin layer comprising a siloxane resin having an electric charge transportable structural unit and a cross-linked structure, the thickness of the single filament and the density of the filament of the brush roller are each from 3 denier to 30 denier and from $4.5\times10^2$ to $15.5\times10^2$ f/cm$^2$ (number of filament per square centimeter), respectively, and the pressure of the elastic rubber blade to the photoreceptor surface is from 5 to 30 g/cm.

25 Claims, 2 Drawing Sheets

ELECTROPHOTOGRAPHIC IMAGE FORMING METHOD, ELECTROPHOTOGRAPHIC IMAGE FORMING APPARATUS, AND PROCESSING CARTRIDGE

DETAILED EXPLANATION OF THE INVENTION

1. Field of the Invention

This invention relates to an electrophotographic image forming method, an electrophotographic image forming apparatus, a processing cartridge and an electrophotographic photoreceptor, particularly relates to an electrophotographic image forming method and an electrophotographic image forming apparatus having a process for cleaning a toner remained on an organic photoreceptor by a brush roller and an elastic rubber blade while the photoreceptor is moving, and a processing cartridge and an electrophotographic photoreceptor to be used in the apparatus.

2. Background of the Invention

Recently, an organic photoreceptor containing an organic photoconductive substance is most widely used for the electrophotographic photoreceptor. The organic photoreceptor has advantages such that the material responding to various exposure light sources from visible light to infrared light can be easily developed, a material without environmental pollution can be selected and the production cost is low, compared with another photoreceptor. However, only a drawback of the organic photoreceptor is weak in the mechanical strength and the surface of the photoreceptor is deteriorated or damaged for a lot of copying or printing.

Generally, in the electrophotographic copying apparatus according to Carlson method, a photoreceptor is uniformly charged and the charge is imagewise eliminated by light exposure to form a static latent image. The static latent image is visualized by developing by a toner, and the toner is transferred to paper and fixed.

However, the toner on the photoreceptor is not all transferred and a part of the toner is remained on the photoreceptor. When the image formation process is repeated under such the condition, a high quality copied image without any contamination cannot be obtained since the latent image formation is disturbed by the influence of the remained toner. Accordingly, it is necessary to remove the remained toner. A fur brush roller, a magnetic brush roller or a blade is usually used for the cleaning means, and the blade is mainly used from the viewpoint of the performance and the structure thereof. A plate of rubber elastic material is usually used for the material of the blade.

As above-mentioned, an electrical and mechanical force are directly applied to the surface of the photoreceptor by the charging means, the developing means, the transferring means and the cleaning means. Accordingly, a high resistivity to such the forces is required to the photoreceptor. Particularly, a high resistivity to the wear or scratch formation of the surface of the photoreceptor caused by the friction, and a high mechanical durability to peel of the layer caused by an impact by intruding a foreign substance or removing a jammed paper are required. Specifically, the durability to the damage and peel of the layer the same as that of an inorganic photoreceptor is strongly demanded.

Until now, various investigations have been performed to satisfy the requirements as above-mentioned.

It has been reported regarding the mechanical durability, that the wearing property of the surface and the toner filming resistivity can be improved by using a bisphenol Z type polycarbonate resin as the binder at the surface of the organic photoreceptor. Japanese Patent Publication Open to Public Inspection (JP O.P.I.) No. 6-118681 discloses the use of a colloidal silica-containing hardenable silicone resin as the surface of the photoreceptor.

However, the photoreceptor using the bisphenol Z type polycarbonate resin is insufficient in the resistivity to the wearing and not has the sufficient durability. Besides, the surface layer of the colloidal silica-containing hardenable silicone resin is superior in the strength and is widely studied for the means for raising the anti-wearing property and the anti-scratch property which are the drawback of the OPC. However, a problem of the electricity property under a low humidity is raised when the siloxane resin is used in the surface layer. Although it has been tried for improve such the problem to reduce the surface electric conductivity by an addition of an electroconductive particle, a problem of occurring an image flowing under a high temperature and a high humidity has been raised. The inventors have found that the electricity property under a condition low temperature and low humidity can be improved by combining a charge transportable structural unit into the siloxane resin (Japanese Patent Application No. 11-70380).

However, a problem that the image quality is deteriorated by an accumulated adhered matter since an adhered matter caused by toner and paper powder on the surface of the photoreceptor are become to be difficultly removed accompanied with the raising the strength of the surface, hitherto the matter adhered on the surface is removed by the wearing of the surface.

PROBLEM TO BE DISSOLVED BY THE INVENTION

The object of the invention is to provide an electrophotographic image forming method, an electrophotographic image forming apparatus, and a processing cartridge and an electrophotographic photoreceptor to be used therein, by which an electrophotographic image with a high image quality can be stably obtained for a long period.

MEANS TO DISSOLVE BY THE INVENTION

As a result of the earnest investigation for the dissolution of the problem mentioned above by the inventors, it is found that the object of the invention can be attained by cleaning an electrophotographic photoreceptor containing a siloxane resin having an electric charge transportable structural unit and a cross-linked structure by a cleaning means having both of an elastic rubber blade and a brush roller. The inventors have found that the object of the invention is attained by the followings.

1. An electrophotographic image forming method comprising the step of cleaning a toner remained on an electrophotographic photoreceptor by a brush roller and an elastic rubber blade after transferring a toner image formed on the electrophotographic photoreceptor to an image receiving material wherein the photoreceptor has a resin layer comprising a siloxane resin having an electric charge transportable structural unit and a cross-linked structure, the thickness of the single filament and the density of the filament of the brush roller are each from 6 denier to 30 denier and from $4.5\times10^2$ to $15.5\times10^2$ f/cm$^2$ (number of filament per square centimeter),respectively, and the pressure of the elastic rubber blade to the photoreceptor surface is from 5 to 30 g/cm.
2. An electrophotographic image forming method comprising the step of cleaning a toner remained on an electrophotographic photoreceptor by a brush roller and an elastic rubber blade after transferring a toner image formed on the electrophotographic photoreceptor to an image receiving material wherein the photoreceptor has a resin layer comprising a siloxane resin having an electric charge transportable structural unit and a cross-linked structure, wherein the toner is cleaned by a brush roller touched to the photoreceptor under a condition of an effective driving torque of from 0.1 kgf·cm to 2.0 kgf·cm and an elastic rubber blade touched to the photoreceptor surface with a pressure of from 5 to 30 g/cm.

Effective driving torque: T=T1−T2

T1: The driving torque of the brush roller when of the brush roller is touched to the photoreceptor T2: The driving torque of the brush roller when of the brush roller is not touched to the photoreceptor 3. The electrophotographic image forming method as described in items 1 and 2 mentioned above, wherein the electric charge transportable structural unit having the following structure is in the structure of the siloxane resin.

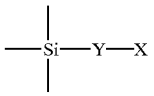

wherein X is a structural unit having an electric charge transport ability and bonded with Y through a carbon atom or a silicon atom constituting the structural unit, Y is a group of two or more atoms or groups without the adjacent bonding atom (Si and C).

4. The electrophotographic image forming method as described in items 1 to 3 mentioned above, wherein Y is an oxygen atom, sulfur atom or an NR group.

R is a hydrogen atom or a monovalent organic group.

5. The electrophotographic image forming method as described in items 1 to 4 mentioned above, wherein the resin layer is a layer containing a siloxane resin having a cross-linked structure and a structural unit having an electric charge transport ability which is obtained by reacting an organic silicon compound having a hydroxyl group or a hydrolyzable group with an electric charge transportable compound having a hydroxyl group.

6. The electrophotographic image forming method as described in items 1 to 5 mentioned above, wherein the resin layer contains an organic fine particle having an average particle diameter of from 0.05 μm to 10 μm.

7. The electrophotographic image forming method as described in item 6 mentioned above, wherein the organic fine particle is a fine particle of resin containing a fluorine atom.

8. The electrophotographic image forming method as described in items 1 to 7 mentioned above, wherein the resin layer contains colloidal silica.

9. An electrophotographic image forming apparatus having a cleaning means for removing a toner remained on the electrophotographic photoreceptor thereof for repeatedly forming images wherein the photoreceptor comprises a siloxane resin containing a structural unit having an electric charge transport ability and a cross-linked structure, and the toner remained on the photoreceptor is removed by a brush roller having a thickness of single filament of from 6 to 30 denier and the density of the filament of from $4.5\times10^2$ to 15.5 f/cm$^2$ (number of filament per square centimeter) and an elastic rubber blade pressed to the surface of the photoreceptor with a pressure of from 5 to 30 g/cm.

10. An electrophotographic image forming apparatus having a cleaning means for removing a toner remained on the electrophotographic photoreceptor thereof for repeatedly forming images wherein the photoreceptor comprises a siloxane resin containing a structural unit having an electric charge transport ability and a cross-linked structure, and the toner remained on the photoreceptor is removed by a brush roller touched to the photoreceptor under a condition of an effective driving torque of from 0.1 kgf·cm to 2.0 kgf·cm and an elastic rubber blade pressed to the surface of the photoreceptor with a pressure of from 5 to 30 g/cm.

Effective driving torque: T=T1−T2

T1: The driving torque of the brush roller when of the brush roller is touched to the photoreceptor T2: The driving torque of the brush roller when of the brush roller is not touched the photoreceptor 11. A processing cartridge to be used in an electrophotographic image forming apparatus having a cleaning means for removing a toner remained on the electrophotographic photoreceptor thereof, in which the photographic photoreceptor having a resin layer comprising a siloxane resin having a structural unit having an electric charge transport ability and a cross-linked structure, and a cleaning means including a brush roller having a filament having a single filament thickness of from 6 to 30 denier and a filament density of $4.5\times10^2$ to 15.5 f/cm$^2$ (filament number per square centimeter) and an elastic rubber blade touched to the photoreceptor surface with a pressure of from 5 to 30 g/cm, are built up to one unit designed so as to be capable of putting onto and taking off from the apparatus.

12. The photoreceptor comprising a resin layer which comprises a structural unit having charge transferable characteristics, siloxane based resin having cross-linking structure, organic particles having an average particle size of 0.05 to 10 μm and an antioxidation agent.

DETAILED DESCRIPTION OF THE INVENTION

An optional material can be used for constituting the brush of the brush roller, and a hydrophobic high molecular weight polymer capable of forming a filament having a high dielectric constant is preferably used. Examples of such the polymer include Rayon, Nylon, a polycarbonate, a polyester, a methacryl resin, an acryl resin, a poly(vinyl chloride), a poly(vinylidene chloride), a polypropylene, a polystyrene, a poly(vinyl acetate), a styrene-butadiene copolymer, a vinylidene chloride-acrylonitrile copolymer, a vinylidene chloride-vinyl acetate copolymer, a vinyl chloride-vinyl acetate-maleic anhydride copolymer, a silicone resin, a silicone/alkyd resin, a phenol-formaldehyde resin, a styrene-alkyd resin and a poly(vinyl acetal) such as poly(vinyl butyral). Rayon, Nylon, polyester, acryl resin and polypropylene are particularly preferred.

The brush may be either electroconductive or electroresistive, and one having a resistivity controlled to an optional value by containing a low resistive material such as carbon in the constituting material may be used.

The thickness of the single filament of the brush is not less than 6 denier and not more than 30 denier. When the thickness is less than 6 denier, the substance adhered on the surface of the photoreceptor cannot be removed since the scrubbing force of the brush is insufficient. When the thickness is exceeding 30 denier, the life of the photoreceptor is shortened since the brush is made too stiff and the surface of the photoreceptor is damaged.

The "denier" is a value expressed by the weight in gram of 9000 meter of the filament.

The density of the filament of the brush is not less than $4.5\times10^2$ f/cm$^2$ and not more than $15.5\times10^2$ f/cm$^2$. When the density is less than $4.5\times10^2$ f/cm$^2$, the adhered substance cannot be uniformly removed since the scrubbing force of the brush is become uneven. When the density is more than $15.5\times10^2$ f/cm$^2$, the toner and foreign substance entered between the filaments cannot be completely removed and packing is occurred with the result that the property of the brush is lost.

The effective driving torque T of the brush roller to be used in the invention is not less than 0.1 kgf·cm and not more than 2.0 kgf·cm, preferably not less than 0.5 kgf·cm and not more than 1.5 kgf·cm. The effective driving torque T is defined by the difference between driving torque T1 and torque T2, (T1–T2), in which T1 is a driving torque of the brush roller measured under the condition that the brush roller and the photoreceptor drum are set in place the brush roller is rotated at the prescribed speed while the brush roller is touched with the photoreceptor drum rotating at a speed the same as that for copying operation, and T2 is a driving torque of the brush roller when the brush roller is rotated at the same speed as in the measurement of T1 without touching to the photoreceptor drum which is removed for measuring T2. The effective driving torque means the load given to the brush roller, which is generated by the relative motion of the photoreceptor drum and the brush roller. The load corresponds to the scrubbing force given onto the photoreceptor surface from the brush roller, and the limitation on the driving torque means that it is necessary to scrub the photoreceptor with suitable force. When the effective driving torque is less than 0.1 kgf·cm, formation of filming caused by the toner or paper powder cannot be inhibited since the scrubbing force is too small and a defect such as unevenness of image is occurred. When the effective driving torque is more than 2.0 kgf·cm, the wearing of the photoreceptor is made too larger and problems such as that fogging is caused by lowering the sensitivity and line defect of the image caused by scratches are raised since the scribing force of the brush to the photoreceptor is excessively large.

FIG. 2 is a schematic drawing of the apparatus used for measuring the torque of the brush roller relating to the invention.

As is shown in FIG. 2, the cylindrical brush supporter 2 of the brush roller 4 is connected to a rotating axis torque detector 8, MD-204R manufactured by Ono Sokuki Co., Ltd., through a microcoupling 7, manufactured by Tokyshu Seikou Co., Ltd., and the torque of the brush roller is read by a digital torque operation display 10, TS-3600A manufactured by Ono Sokuki Co., Ltd., when the brush roller is rotated by a motor 9 so that the rotation speed is become the prescribed value.

For the material of the supporter of the roller of the brush roller according to the invention, mainly a metal such as stainless steel and aluminum, paper and plastics may be used, which is not limitative.

A flicker for beating off the toner or foreign substance from the brush may be provided according to necessity.

The brush roller used in the invention is preferably constituted by a cylindrical support and a brush adhered thereon through an adhering layer as shown in FIG. 1.

FIG. 1 is a schematic drawing showing the constitution of the organic photoreceptor, the brush roller and the elastic rubber blade relating to the invention.

In FIG. 1, the toner image formed on the organic photoreceptor 1 is transferred onto the medium while rotating in the direction of the arrow (figure is omitted). The toner not transferred is remained on the organic photoreceptor and rotated in the direction of the arrow. Almost all of the remained toner image is scribed off by the cylindrical brush support 2, adhesion layer 3, and brush roller 4. Moreover, the further remained toner image is scribed off by the elastic rubber blade 5. The elastic rubber blade 5 is pressed against the photoreceptor surface by the supporting member 6 with a pressure of from 5 to 30 g/cm.

It is preferable that the elastic rubber blade is provided on the supporting member so as to have a free edge as shown in FIG. 1.

In the invention, slipping through of the toner is occurred since the cleaning is performed insufficiently when the pressure of the elastic rubber blade to the photoreceptor is less than 5 g/cm. When the pressure is more than 30 g/cm, the sensitivity of the photoreceptor is lowered and the image defect such as fogging is occurred since wearing of the photoreceptor is become too large.

The free edge of the elastic rubber blade is touched in the direction opposite to the rotating direction of the photoreceptor.

It is preferable that the elastic rubber blade has a rubber hardness of from 60° to 70° according to JIS A, a repulsion elasticity of from 30% to 70%, a Young's modulus of from 30 to 60 kgf/cm$^2$, a thickness of from 1.5 mm to 3.0 mm and a free length of from 7 to 12 mm. However these values are not limited thereto, respectively.

The photoreceptor, which contains a charge transferable polysiloxane hardenable resin at the surface layer is described.

In the invention, the cross-linked siloxane resin having the charge transportable structural unit can be prepared by a known method using an organic silicon compound having hydroxyl group or a hydrolyzable group. Such the organic silicon compound is represented by the following Formula A, B, C or D.

Formula A

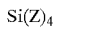

$Si(Z)_4$

Formula B

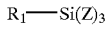

$R_1—Si(Z)_3$

Formula C

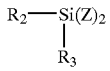

$R_2—Si(Z)_2$ | $R_3$

Formula D

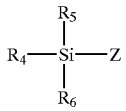

$R_5$ | $R_4—Si—Z$ | $R_6$

In the formulas, $R_1$ through $R_6$ are each an organic group in which a carbon atom thereof is directly boned with the silicon atom in the formula, X is a hydroxyl group or a hyrolyzable group.

When X in the above formulas is a hydrolyzable group, examples thereof include a methoxy group, an ethoxy group, a methylethyl ketoxime group, a diethylamino group, an acetoxy group, a propenoxy group, a propoxy group, a butoxy group and a methoxyethoxy group. Example of the organic group represented by $R_1$ through $R_6$ in each of which a carbon atom is directly bonded to the silicon atom, include an alkyl group such as a methyl group, an ethyl group, a propyl group and a butyl group, an aryl group such as a phenyl group, a tolyl group, a naphthyl group and a biphenyl group, an epoxy-containing group such as a γ-glycidoxypropyl group and β-(3,4-epoxycyclohexyl)ethyl group, an (metha)acryloyl-containing group such as a γ-acryloxypropyl group and a γ-methacryloxypropyl group, a hydroxyl-containing group such as a γ-hydroxypropyl group and a 2,3-dihydroxypropyloxypropyl group, a vinyl-containing group such as a vinyl group and a propenyl group, a mercapto-containing group such as a γ-mercaptopropyl group, an amino-containing group such as a γ-aminopropyl group and an N-β-(aminoethyl)-γ-aminopropyl group, a halogen-containing group such as a γ-chloropropyl group, an 1,1,1-trifluoropropyl group, a non-afluorohexyl group and perfluorooctylethyl group, and an alkyl group substituted by a nitro group or a cyano group. The organic groups represented by $R_1$ through $R_6$ may be the same as or different from each other.

Generally, the reaction of the organic siloxane compound for preparing a charge transportable polysiloxane resin, that is also called as siloxane resin having structural unit capable of charge transferring property and crosslinking structure, is inhibited when the number n of the hydrolyzable group is one. When n is 2, 3 or 4, the high molecular weight making reaction tends easily to be progressed, and when n 3 or 4, the cross-linking reaction can be strongly progressed. Accordingly, controlling Such the factors can control the storage ability of the coating liquid of the layer and the hardness of the coated layer.

A hydrolysis condensation product, that is prepared by subjecting the organic silicone compound mentioned above to hydrolysis under acid or base as condition and oligomerization or polymerization, may be employed as a starting material for preparing a charge transportable polysiloxane resin.

The siloxane resin of the invention is a resin which is formed and hardened by a reaction (including a hydrolyzing, and a reaction in the presence of a catalyst or a cross-linking agent) of a monomer, an oligomer or a polymer having a siloxane bond in the chemical structural thereof unit to form a three-dimensional network structure. In another words, the siloxane resin of the invention means a cross-linked siloxane resin formed as a result of the formation of three-dimensional network structure by acceleration of siloxane bonding formation of the organic compound having a siloxane bond by a hydrolyzing reaction and a dehydrating reaction.

Moreover, the siloxane resin may be a resin containing a silica particle as a part of the cross-linked structure by adding a colloidal silica particle having a hydroxyl group or a hydrolyzable group.

In the invention the cross-linked siloxane resin having a charge transportable structural unit is a siloxane resin in which a chemical structure showing a drift mobility of electron or a hole (i. e., the structural unit having a charge transporting ability) is built-in. In concrete, the cross-linked siloxane resin having the charge transporting ability according to the invention has a compound usually used as a charge transporting substance (hereinafter referred to a charge transportable compound or CTM) as a partial structure thereof.

In other definition, the charge transportable structural unit is a chemical structural unit or a residue of charge transportable compound by which an electric current caused by charge transportation can be detected by a known method for detecting the charge transportation ability such as Time-Of-Flight method.

The charge transferable compound which can form a structural unit having the charge transporting ability in the polysiloxane resin through reaction with an organic silicone compound is described.

Examples of hole transporting type CTM which each are contained in the siloxane resin as the partial structure thereof are as follows: oxazole, oxadiazole, thiazole, triazole, imidazole, imidazolone, imidazoline, bis-imidazolidine, styryl, hydrazone, benzidine, pyrazoline, stilbene compounds, amine, oxazolone, benzothiazole, benzimidazole, quinazoline, benzofuran, acridine, phenazine, aminostilbene, poly-N-vinylcarbazole, poly-1-vinylpyrene and poly-9-vinylanthrathene.

Examples of electron transporting type CTM are as follows: succinic anhydride, maleic anhydride, phthalic anhydride, pyromellitic anhydride, mellitic anhydride, tetracyanoethylene, tetracyanoquinodimethane, nitrobenzene, dinitrobenzene, trinitrobenzene, tetranitrobenzene, nitrobenzonitrile, picryl chloride, quinonechloroimide, chloranil, bromanil, benzoquinone, naphthoquinone, diphenoquinone, tropoquinone, anthraquinone, 1-chloro-anthraquinone, dinitroanthraquinone, 4-nitrobenzophenone, 4,4'-dinitrobenzophenone, 4-nitrobenzalmalondinitrile, α-cyano-β-(p-cyanophenyl)-2-(p-chlorophenyl)ethylene, 2,7-dinitrofluorene, 2,4,7-trinitrofluorenone, 2,4,5,7-tetranitrofluorenone, 9-fluorenylidenedicyanomethylenemalono-nitrile, polynitro-9-fluorenylidenedicyanomethylenemalono-dinitrile, picric acid, o-nitrobenzoic acid, p-nitrobenzoic acid, 3,5-dinitrobenzoic acid, pentafluorobenzoic acid, 5-nitrosalicylic acid, 3,5-dinitroalicylic acid, phthalic acid and mellitic acid.

In the invention, preferable charge transportable structural units are residues of usually used charge transporting compounds such as mentioned above. The residue is bonded with the bonding atom or group represented by Z through the carbon atom or the silicon atom constituting the charge transporting compound so as to be contained in the siloxane resin.

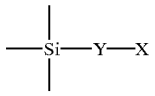

In the formula, X is a charge transportable structural unit, which bonds to Y in the formula through a carbon atom or a silicone atom constituting the structural unit. Y is a bonding group or an atom having two or more valences excluding neighboring bonding atoms (Si and C).

When Y is three or more valent atom, the bonding hand other than those each bonding with Si and C is bonded with any atom constituting the hardened resin, or has structure (group) bonding to another atom or molecular group.

In the above-mentioned formula, the atom represented by Z is preferably an oxygen atom O, a sulfur atom S or nitrogen atom N.

In the formula, Y is a nitrogen atom (N), the above-mentioned bonding group is represented by —NR—, wherein R is a hydrogen atom or a mono-valent organic group.

Although the charge transportable structural unit X is shown as a mono-valent group in the formula, the structural unit may be bonded as a two or more valences cross-linking group in the hardened resin or as a simple pendant group when the charge transporting compounds to be reacted with the siloxane resin has two or more functional groups.

The above mentioned O, S or N atom is a bonding atom or group for taking the charge transportable structural unit into the siloxane resin, which is formed by reaction of a hydroxyl group, mercapto group or amine introduced into the charge transportable compound with the organic silicon compound having a hydroxyl group or a hydrolyzable group.

Next, the charge transportable compounds having a hydroxyl group, a mercapto group, and an amine group, employed in the present invention, will be described.

The charge transportable compounds having a hydroxyl group as described herein are those having commonly employed structures, and in addition, also having a hydroxyl group. Namely, representatively listed can be the charge transportable compounds represented by the general formula shown below, which bond to siloxane based organic silicone compounds and are capable of forming a resin layer. However, the compounds are not limited to the structure shown below, but may also be those having charge transportability as well as a hydroxyl group.

$$X—(R_7—OH)_m \quad m \geqq 1$$

wherein

X: structural unit providing charge transportability $R_7$: single bonding group, each of a substituted or an unsubstituted alkylene or arylene group m: preferably 1 to 5

Of these, listed as representative compounds are such as those described below. Further, for example, triethanolamine based compounds as described herein are those containing a triarylamine structure such as triphenylamine and the like, as well as having a hydroxyl group which bonds to a carbon atom via the carbon atom constituting said group.

1. Triarylamine Based Compounds

T-1

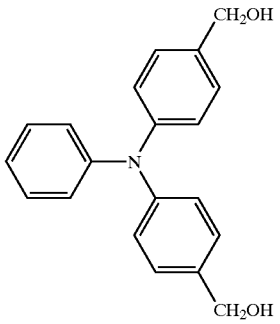

T-2

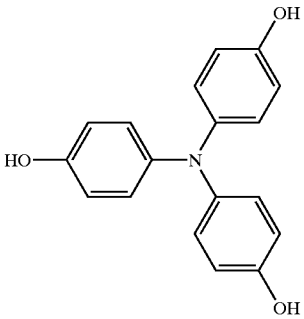

-continued

T-3

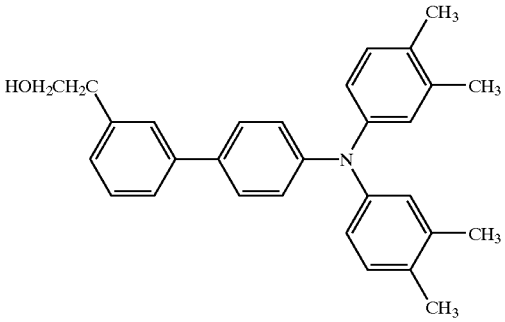

T-4

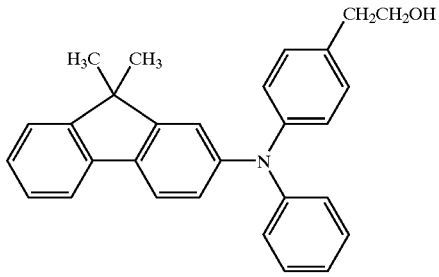

2. Hydrazine Based Compounds

H-1

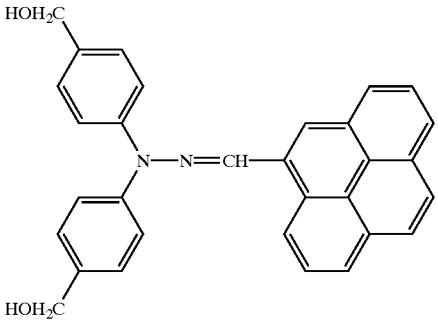

H-2

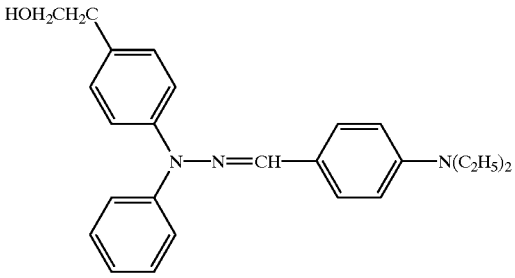

H-3

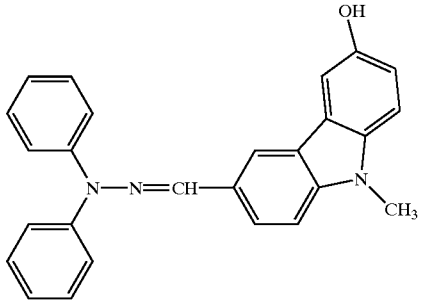

3. Stilbene Based Compounds

-continued
S-1
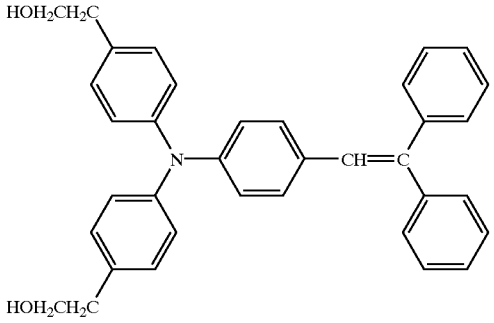
S-2
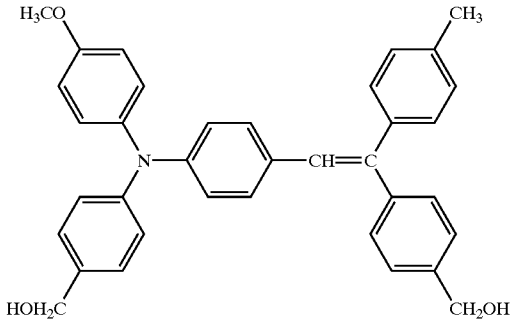
S-3
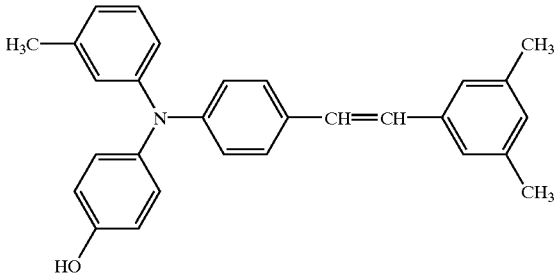
4. Benzidine Based Compounds
Be-1
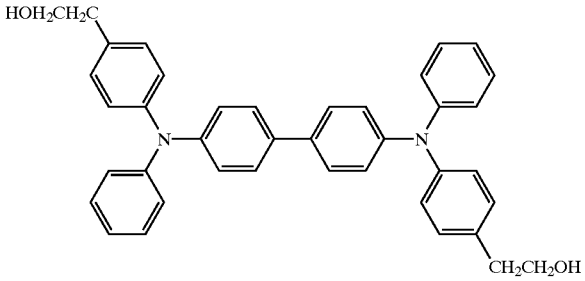
-continued
Be-2
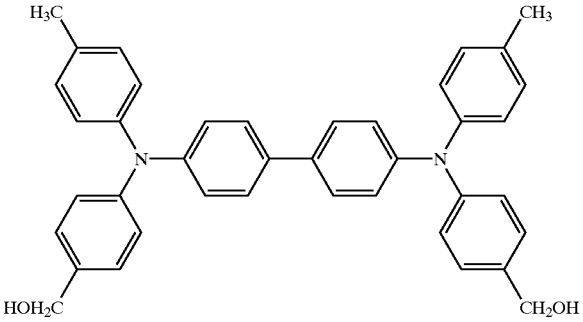
5. Butadiene Based Compounds
Bu-1
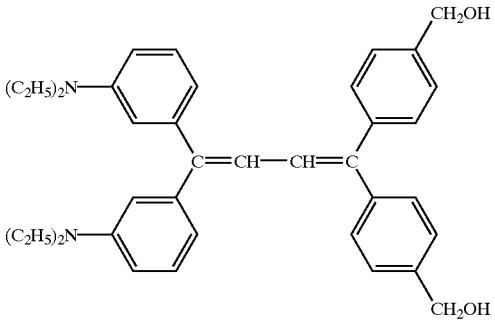
6. Other Compounds
So-1
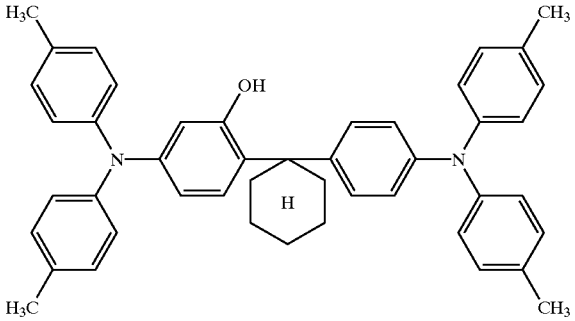
So-2
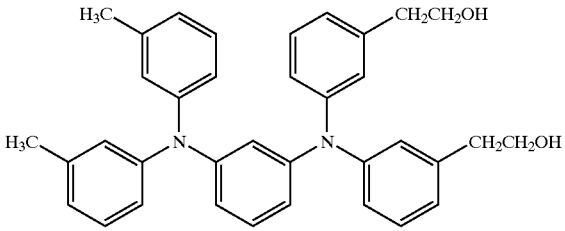
Next, a synthesis example of the charge transportable compound will be described.

Synthesis of Exemplified Compound T-1

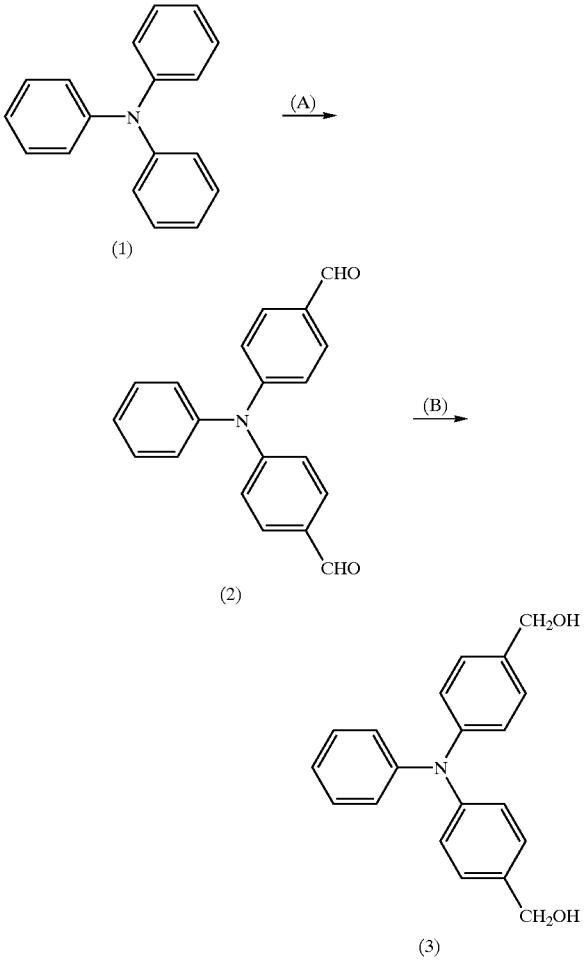

Step A

Placed in a four-neck flask equipped with a thermometer, a cooling tube, a stirrer, and a dropping funnel were 49 g of Compound (1) and 184 g of phosphorus oxychloride, which were heated and thereby dissolved. Employing the dropping funnel, 117 g of dimethylformamide was gradually added dropwise. Thereafter, the resulting mixture was stirred for about 15 hours while the temperature of the reacting solution was maintained between 85 and 95° C. Subsequently, the reaction solution was gradually poured into warm water, having a much larger volume than the reaction solution, and the resulting mixture was slowly cooled while stirring.

Deposited crystals were collected through filtration, then dried, and thus Compound (2) was obtained by purifying the resulting deposits through the adsorption of impurities employing silica gel and the like, and recrystallization employing acetonitrile. The yield was 30 g.

Step B

Placed in a flask were 30 g of Compound (2) and 100 ml of ethanol, and the resulting mixture was stirred. After gradually adding 1.9 g of sodium boron hydride, the resulting mixture was stirred for 2 hours while maintaining the temperature between 40 and 60° C. Subsequently, the reaction solution was poured into about 300 ml of water, and crystals were deposited while stirring. The deposited crystals were collected with filtration, well washed, and dried to obtain Compound (3). The yield was 30 g.

Synthesis of Exemplified Compound S-1

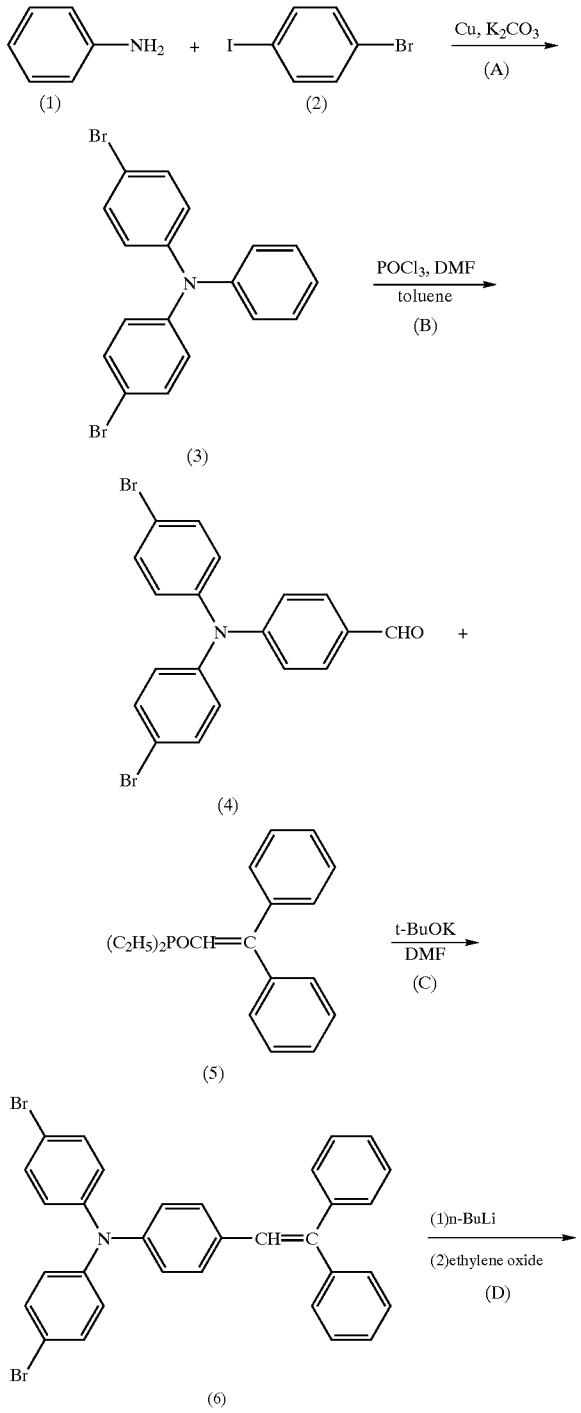

-continued

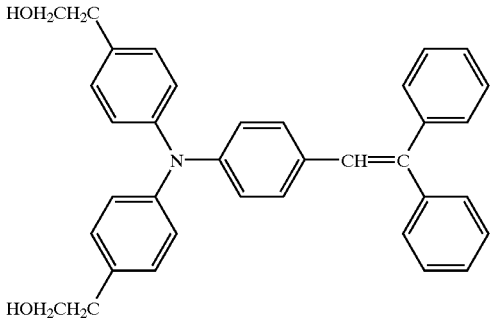

(7)

Step A

Placed in a 300 ml flask equipped with a thermometer and a stirrer were 30 g of Cu, 60 g of $K_2CO_3$, 8 g of Compound (1), and 100 g of Compound (2) and the resulting mixture was heated to about 180 ° C., and then stirred for 20 hours. After cooling, reaction products were collected through filtration and subjected to column purification to obtain 7 g of Compound (3).

Step B

A 100 ml flask equipped with a thermometer, a dropping funnel, an argon gas introducing unit, and a stirrer was filled with argon gas. Placed in said flask were 7 g of said Compound (3), 50 ml of toluene, and 3 g of phosphoryl chloride. Added slowly to the resulting mixture was dropwise 2 g of DMF and the resulting mixture was then heated to about 80° C. and stirred for 16 hours. The resultant was poured into about 70° C. water and then cooled. The resulting mixture was subjected to extraction employing toluene. The extract was washed until the pH of the wash water became 7. The resulting extract was dried employing sodium sulfate, then concentrated, and was then subjected to column purification to obtain 5 g of Compound (4).

Step C

Placed in a 100 ml flask equipped with an argon gas introducing unit and a stirrer were 1.0 g of t-BuOK and 60 ml of DMF, and said flask was filled with argon gas. Added to the resulting mixture were 2.0 g of said Compound (4) and 2.2 g of Compound 5, and the resulting mixture was stirred at room temperature for one hour. The resultant was poured into water having a much larger volume than the same, and was then subjected to extraction employing toluene. The resulting extract was water washed, and then dried employing sodium sulfate. Thereafter, the dried extract was concentrated, and subjected to column purification to obtain 2.44 g of Compound (6).

Step D

Placed in a 100 ml flask equipped with a thermometer, a dropping funnel, an argon gas introducing unit, and a stirrer was toluene, and the flask was then filled with argon gas. To this, 15 ml of a hexane solution (1.72 M) of n-BuLi was added and the resulting mixture was heated to 50° C. Added dropwise to said resulting mixture was a solution prepared by dissolving 2.44 g of Compound (6) in 30 ml of toluene, and the resulting mixture was stirred for 3 hours while maintaining the temperature at 50° C. After cooling the resulting mixture to −40° C., 8 ml of ethylene oxide were added, heated to −15° C. and stirred for one hour. Thereafter, the resulting mixture was heated to room temperature, and mixed with 5 ml of water, subjected to extraction employing 200 ml of ether. The resulting extract was washed with saturated salt water. After washing until the pH of the washing water became, the extract was dried employing sodium sulfate, concentrated and subjected to column purification to obtain 1.0 g of Compound (7).

Next, specific examples of charge transportable compounds having a mercapto group will be illustrated below.

The charge transportable compounds having a mercapto group as described herein are charge transport compounds having commonly employed structures, as well as compounds having a mercapto group. Namely, representatively listed can be the charge transportable compounds represented by the general formula described below, which bond to organic silicone compounds and are capable of forming a resin layer. However, the compounds are not limited to the structure described below but may also be those having charge transportability as well as a mercapto group.

$X—(R_8—SH)_m$ $m \geqq 1$ wherein

X: charge transportability providing group $R_8$: single bonding group, each of a substituted or an unsubstituted alkylene group or an arylene group m: integer of 1 to 5

Of these, listed as representative compounds are such as those described below.

V-1

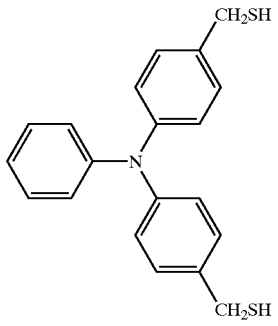

V-2

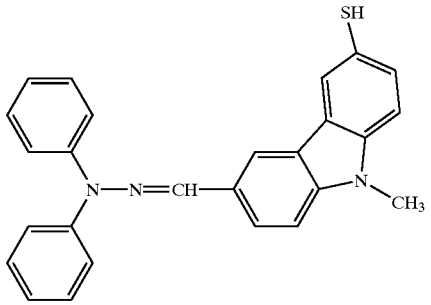

V-3

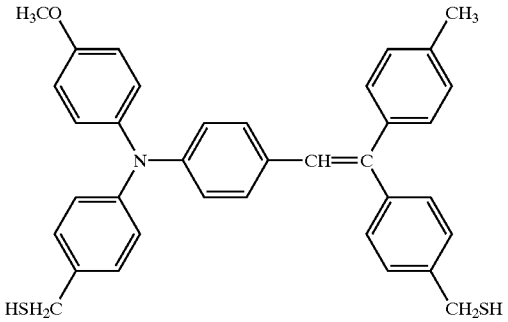

-continued

V-4

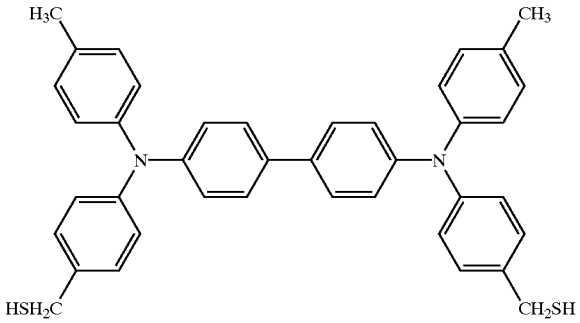

V-5

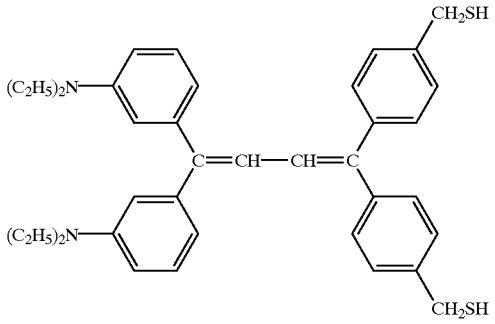

Further, specific examples of charge transportable compounds having an amino group are illustrated below.

The charge transportable compounds having an amino group as described herein are charge transport compounds having commonly employed structures, as well as compounds having an amino group. Namely, representatively listed can be the charge transportable compounds represented by the general formula described below, which bond to organic silicone compounds and are capable of forming a resin layer. However, the compounds are not limited to the structure described below but may be those having charge transportability as well as an amino group.

$X—(R_9—NR_{10}H)_m$ $m \geqq 1$ wherein

X: charge transportability providing group $R_9$: single bonding group, each of a substituted or an unsubstituted alkylene group or an arylene group $R_{10}$: H, a substituted or unsubstituted alkyl group, a substituted or an unsubstituted aryl group m: 1 to 5

Of these, listed as representative compounds are such as those described below.

W-1

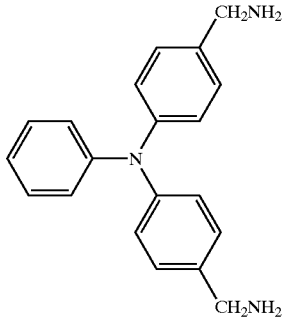

W-2

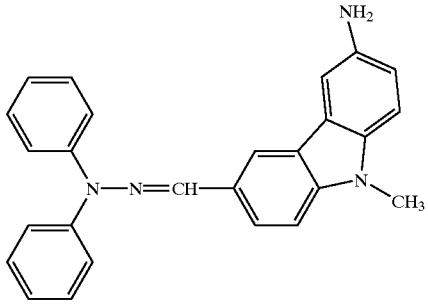

W-3

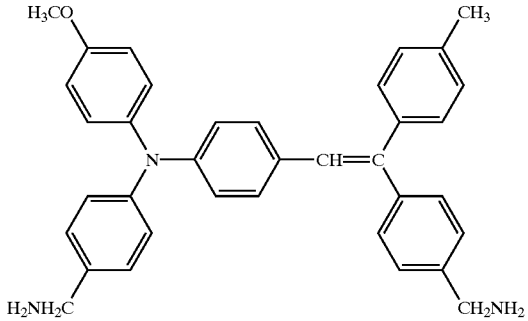

W-4

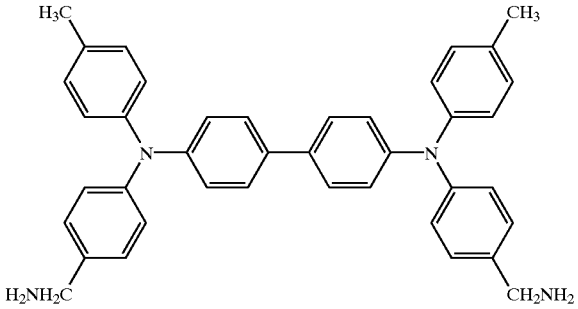

-continued

W-5

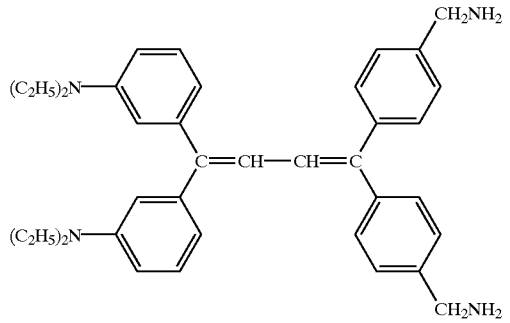

W-6

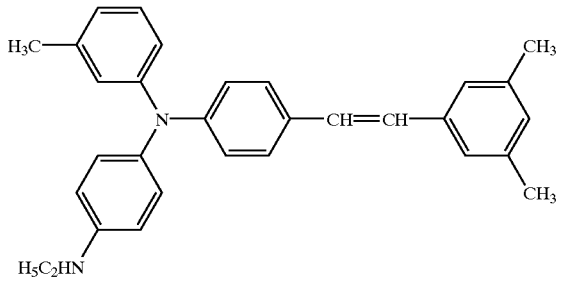

Of charge transportable compounds having an amino group, in the case of primary amine compounds (—$NH_2$), two hydrogen atoms may react with the organic silicone compound, and bonding to the siloxane structure may take place. In the cage of secondary amine compounds (—$NHR_{10}$), one hydrogen atom may react with the organic silicone compound, and the remaining $R_{10}$ may be any of a remaining group as a branch, a group resulting in a crosslinking reaction, or a compound group having charge transportability.

Further, transportable compounds having a group containing silicone atom are illustrated below.

The charge transportable compounds having a group containing silicone atom are charge transport compounds having following structure. The compound is contained in a polysiloxane hardenable resin as a partial structure through silicone atom in the molecule.

X—(—Y—Si $(R_{11})_{3-a}(R_{12})_a$))n wherein

X: a group containing structural unit providing charge transportability, $R_{11}$: hydrogen atom, a substituted or unsubstituted alkyl group, a substituted or an unsubstituted aryl group, $R_{12}$: hydrolysable group or a hydroxy group, Y: a substituted or unsubstituted alkylene group, a substituted or an unsubstituted arylene group, a: an integer of 1 to 3, and n: an integer.

Of these, representative compounds are such as those described below.

Raw materials of the siloxane resin: The compounds represented Formula A through D (hereinafter referred to A through D) respectively. The ratio of those is preferably to use organic silicon compound: from 0.05 to 1 moles of C+D component per 1 mole of A+B component.

When colloidal silica E is added, it is preferable to use from 1 to 30 parts by weight of E per 100 parts by weight of total amount of A+B+C+D component.

The adding amount of the reactive charge transportable compound F capable of forming the resin layer by reacting with the organic silicon compound and the colloidal silica is preferably from 1 to 500 parts by weight per 100 parts by weight of the total amount of the component of A+B+C+D. When the amount of A+B component is smaller than the above-mentioned range, the hardness of the siloxane resin layer is shortened since the cross-linking density is too low. When the amount of A+B component is too large, the hardness of the layer is sufficient but the layer is become fragile. A shortage and an excess of the colloidal silica component E show similar effects to those of the component A+B, respectively. A too small amount of component F causes lowering in the sensitivity and raising in the remained potential since the charge transporting ability of the siloxane resin layer is become too low. When the amount of component F is excessive, the strength of the resin layer tends to be lowered.

The cross-linked siloxane resign having the charge transporting ability according to the invention may be prepared by forming a three-dimensional network structure by formation of a new chemical bond by adding a catalyst or a cross-linking agent to a monomer, an oligomer or a polymer each previously having a siloxane bond in the structural unit thereof. The resin may also be prepared by forming three-dimensional network structure by acceleration of the siloxane bonding of a monomer, an oligomer of a polymer by a hydrolyzing reaction and a dehydration condensation reaction thereafter.

Usually, the three-dimensional network structure can be formed by a condensation reaction of a composition containing alkoxysilane or alkoxysilane and colloidal silica.

Examples of the catalyst for forming the three-dimensional network structure include an organic carboxylic acid, nitrous acid, sulfurous acid, aluminic acid, a carbonate or thiocyanate of an alkali metal, an organic amine salt such as tetramethylammonium hydroxide and tetramethylammonium acetate, an organic tin compound such as stannous octenate, dibutyl tin dictate, dibutyl tin dilaurate, dibutyl tin mercaptide, dibutyl tin thiocarboxylate and dibutyl tin maleate, an aluminum or zinc salt of octenoic acid or naphthenic acid and an acetylacetone complex.

Further, antioxidants having a partial structure of hindered phenol, hindered amine, thioether, or phosphite may be incorporated into the resin layer of the present invention, and are effective for the improvement of preventing occurrence of fogging and blurring of image in high temperature and high moisture condition. Particularly hindered phenol and hindered amine antioxidants are effective for such improvement of preventing occurrence of fogging and blurring of image in high temperature and high moisture condition.

Content of the antioxidant such as hindered phenol or hindered amine is preferably 0.01 to 10 weight % in the resin layer. In case of the content of not more than 0.01 weight %, sufficient effect for the improvement of preventing occurrence of fogging and blurring of image in high temperature and high moisture condition is not expected. In case of the content of more than 10 weight %, charge transportation ability decreases, residual potential becomes apt to increase and film strength degrades.

The antioxidant may be incorporated in the lower layer such as charge generation layer, charge transportation layer or inter layer if necessary. Content of addition of the antioxidant is preferably 0.01 to 10 weight % in the layer.

The hindered phenols as described herein means compounds having a branched alkyl group in the ortho position relative to the hydroxyl group of a phenol compound and derivatives thereof. (The hydroxyl group may be modified to an alkoxy group.)

Further, listed as hindered amines are compounds having an organic group represented by the following structural formula:

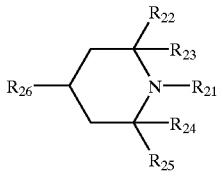

wherein $R_{21}$ represents a hydrogen atom or a univalent organic group, $R_{22}$, $R_{23}$, $R_{24}$, and $R_{25}$ each represents an alkyl group, and $R_{26}$ represents a hydrogen atom, a hydroxyl group, or a univalent organic group.

Listed as antioxidants having a partial hindered phenol structure are compounds described in JP O.P.I.No. 1-118137 (on pages 7 to 14).

Listed as antioxidants having a partial hindered amine structure are compounds described in JP O.P.I.No. 1-118138 (on pages 7 to 9).

Examples of antioxidant available on the market include the followings.

Hindered phenol type antioxidant: Ilganox 1076, Ilganox 1010, Ilganox 1098, Ilganox 245, Ilganox 1330, Ilganox 3114, Ilganox 1076, and 3,5-di-t-butyl-4-hydroxybiphenyl.

Hindered amine type antioxidant: Sanol LS2626, Sanol LS765, Sanol LS770, Sanol LS744, Tinuvin 144, Tinuvin 622LD, Mark LA57, Mark LA67, Mark LA62, Mark LA68 and Mark LA63.

Organic Fine Particle

The organic fine particles have average volume diameter of 0.05 to 10 μm, preferably 0.1 to 5 μm. They are added in a resin layer of the photoreceptor in an amount of 0.01 to 50 weight %. Examples of the organic fine particles include resin fine particles of polytetrafluoroethylene, polychlorotrifluoroethylene, polyfluoridevinylidne, polyfluoroethylene, polydichlorodifluoroethylene, tetrafluoroethylene-perfluoroalkylvinylether copolymer, tetrafluoroethylene-hexafluoropropylene copolymer, tetrafluoroethylene-ethylene copolymer, tetrafluoroethylene-hexafluoropropylene-perfluoroalkylvinylether copolymer, silicone resin, polyethylene, polypropylene and melamine. Among those resin fine particles containing fluorine atom are preferable. Cleaning of residual toner becomes easy by incorporating the resin fine particles containing fluorine atom in the resin layer.

The layer configuration of the electrophotographic photoreceptor of the present invention is not particularly limited. However, the preferred configuration is one in which the resin layer of the present invention is applied onto a photosensitive layer, such as a charge generating layer, a charge transport layer, or a charge generating-transport layer (a single layer type photosensitive layer which has both functions of charge generation and charge transport). Further, each of said charge generating layer, charge transport layer or charge generating-charge transport layer may be comprised of a plurality of layers.

The charge generating materials (CGM) incorporated into the photosensitive layer of the present invention may be employed individually or in combination with a suitable binder resin to form a resin layer. The representative examples of the charge generating materials include, for example, phthalocyanine pigments, polyring quinone pigments, azo pigments, perylene pigments, indigo pigments, quinacridone pigments, azulanium pigments, squarilium dyes, cyanine dyes, pyrylium dyes, thiopyrylium dyes, xanthene dyes, triphenylmethane dyes, styryl dyes etc. The CGM is employed solely or in combination with suitable binder resin to form a layer.

Charge transport materials (CTM) incorporated into the above-mentioned photosensitive layer include, for example, oxazole derivatives, oxadiazole derivatives, thiazole derivatives, thiadiazole derivatives, triazole derivatives, imidazole derivatives, imidazolone derivatives, imidazoline derivatives, bisimidazolidine derivatives, styryl compounds, hydrazone compounds, benzidine compounds, pyrazoline derivatives, stilbene compounds, amine derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-1-vinylpyrene, poly-9-vinylanthracene and the like. These charge transport materials are generally employed together with a binder to form a layer.

Binder resins, which are incorporated into a single-layered photosensitive layer, a charge generating layer (CGL) and a charge transport layer (CTL), include polycarbonate resins, polyester resins, polystyrene resins, methacrylic resins, acrylic resins, polyvinyl chloride resins, polyvinylidene chloride resins, polyvinyl butyral resins, polyvinyl acetate resins, styrene-butadiene resins, vinylidene chloride-acrylonitrile copolymer resins, vinyl chloride-maleic anhydride copolymer resins, urethane resins, silicon resins, epoxy resins, silicon-alkyd resins, phenol resins, polysilicone resins, polyvinyl carbazole etc.

In the present invention, the ratio of the charge generating material in the charge generating layer to the binder resin is preferably between 1:10 and 10:1 in terms of weight ratio. Further, the thickness of the charge generating layer is preferably no more than 5 μm, and is more preferably between 0.05 and 2 μm.

Furthermore, the charge generating layer is formed by coating a composition prepared by dissolving the above-mentioned charge generating material along with the binder resin in a suitable solvent and subsequently dried. The mixing ratio of the charge transport materials to the binder resin is preferably between 10:1 and 1:10 in terms of weight ratio.

The thickness of the charge transport layer is preferably between 5 and 50 μm, and is more preferably between 10 and 40 μm. Furthermore, when a plurality of charge transport layers are provided, the thickness of the upper charge transport layer is preferably no more than 10 μm, and is preferably less than the total layer thickness of the charge transport layer provided under the upper layer of the charge transport layer.

The hardenable siloxane resin layer may share the function of the aforementioned charge transport layer. However, the hardenable siloxane resin layer is preferably provided as another layer on a photosensitive layer such as a charge transport layer or a charge generating layer, or a single layer type charge generating-transport layer. In such cases, an adhesive layer is preferably provided between the aforementioned photosensitive layer and the resin layer of the present invention.

Next, listed as an electrically conductive support of the electrophotographic photoreceptor of the present invention is:

1) metal plates such as an aluminum plate, a stainless steel plate, and the like 2) those in which a thin layer of metal such as aluminum, palladium, gold, and the like is provided on a support such as paper, plastic film, and the like, employing lamination or vacuum evaporation
3) those in which the layer of an electrically conductive compound such as an electrically conductive polymer, indium oxide, tin oxide, and the like is provided on a support such as paper, plastic film, and the like, employing coating or vacuum evaporation, and the like.

Employed mainly as materials for the electrically conductive support employed in the present invention are metals such as aluminum, copper, brass, steel stainless steel, and the like, as well as plastics. Any of these is processed in a belt shape or drum shape, and then employed. Commonly thin-walled cylindrical aluminum tubes produced by extrusion or drawing are frequently employed.

The electrically conductive support may have an anodized aluminum film subjected to heat-sealing processing.

The shape of the electrically conductive support may be drum, sheet or belt form, suitable for the electrophotographic apparatus.

Listed as solvents or dispersion media employed to produce the photoreceptor of the present invention are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and the like, however the present invention is not limited these. Of these, most preferably employed are dichloromethane, 1,2-dichloroethane or methyl ethyl ketone. Furthermore, these solvents may be employed individually or in combination of two types or more.

Next, employed as coating methods to produce the electrophotographic photoreceptor of the present invention may be a dip coating method, a spray coating method, a circular amount regulating type coating method, and the like. However, in order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. Further, the above-mentioned spray coating is, for example, described in JP O.P.I.Nos. 3-90250 and 3-269238, while the above-mentioned circular amount control type coating is detailed in, for example, JP O.P.I.No. 58-189061.

The photosensitive layer is prepared by heat drying at temperature of more than 50° C. or higher, preferably 60 to 200° C. after forming the surface layer by coating. The residual coating solvent can be reduced and at the same time, the hardenable layer can be hardened sufficiently.

In the present invention, an interlayer, functioning as a barrier, may be provided between the electrically conductive support and the photosensitive layer.

Listed as an interlayer are materials for the interlayer such as casein, polyvinyl alcohol, nitrocellulose, ethylene-acrylic acid copolymer, polyvinyl butyral, phenol resins, polyamides (nylon 6, nylon 66, nylon 610, copolymerized nylon, alkoxymethylated nylon, etc.), polyurethane, gelatin and aluminum oxide, or hardening type interlayers employing metal alkoxides, organic metal complexes, silane coupling agents as described in JP O.P.I.No. 9-68870. The thickness of the interlayer is preferably between 0.1 and 10 $\mu$m, and is most preferably between 0.1 and 5 $\mu$m.

In the photoreceptor of the invention a conductive layer may be provided between the support and the inter layer for the purposes of providing a coating to compensate surface defects of the surface of the support and preventing of occurrence of interference mottle which becomes problematic when the image writing source is lager light. The conductive layer can be formed by coating a composition in which conductive powder such as carbon black, metal particles or metal oxide particles are dispersed in suitable binder resin and drying it. The thickness of the conductive layer is preferably 5 to 40 $\mu$m, particularly 10 to 30 $\mu$m.

The electrophotographic photoreceptor of the present invention may generally be applied to electrophotographic apparatuses such as copiers, laser printers, LED printers, liquid crystal shutter printers, etc. In addition, it may widely be applied to apparatuses for display, recording, offset printing, plate making, facsimile, to which electrophotographic techniques are applied.

FIG. 3 shows a cross-sectional view of an image forming apparatus comprising the electrophotographic photoreceptor of the present invention.

In FIG. 3, reference numeral 11 is a photoreceptor drum (a photosensitive body) which is an image holding body. The photoreceptor is prepared by applying the resin layer of the present invention onto an organic photosensitive layer which has been applied onto the drum, which is grounded and is mechanically rotated clockwise. Reference numeral 12 is a scorotron charging unit, and the circumferential surface of the photoreceptor drum 10 is uniformly charged through corona discharge. Prior to charging with the use of this charging unit 12, the charge on the circumferential surface of the photoreceptor may be removed by exposure from exposure section 23 employing light-emitting diodes in order to eliminate the hysteresis of the photoreceptor due to the most recent image formation.

After the photoreceptor is uniformly charged, image exposure is carried out based on image signals employing image exposure unit 13. The image exposure unit 13 in FIG. 3 employs a laser diode (not shown) as the exposure light source. Scanning on the photoreceptor drum is carried out by light of which optical path is bent by reflection mirror 132 after the light has passed through rotating polygonal mirror 131, fθ lens, and the like, and an electrostatic image is formed.

The resulting electrostatic latent image is subsequently developed by development units 14. Around the photoreceptor drum 11, development units 14 are provided, each of which comprises a developer material comprised of a toner such as yellow (Y), magenta (M), cyan (C), black (K), or the like, together with a carrier. First, the first color development is carried out employing development sleeve which has a built-in magnet and rotates along with the developer material. The developer material consists of a carrier prepared by coating an insulating resin around a ferrite particle as a core, and a toner prepared by adding a corresponding colored pigment, a charge control agent, silica, titanium oxide, and the like, to polyester as a major material. The developer material is regulated by a layer forming means, which is not shown in the figure, so as to form a layer having a thickness of 100 to 600 $\mu$m on the development sleeve, and conveyed to a development zone to achieve development. At the time, development is generally carried out by applying direct current and/or alternative current bias voltage to the gap between the photoreceptor drum 11 and the development sleeve 141.

In the case of color image formation, after visualizing the first color image, the second color image formation is started. Uniform charging is again carried out employing the scorotron charging unit 12, and the second color latent image is formed by the image exposure unit 13. The third and fourth color images are formed by the same image forming processes as those for the second color image, and four color images are visualized on the circumferential surface of the photoreceptor drum 11.

On the other hand, in a monochromatic electrophotographic apparatus, the development unit 14 comprises only black toner and single development forms an image.

After forming an image, recording sheet P is supplied to a transfer zone employing the rotation of paper feeding roller 17 when transfer timing is adjusted.

In the transfer zone, transfer roller (in the transfer unit) 18 is brought into pressure contact with the circumferential surface of the photoreceptor drum 11 in synchronized transfer timing, and multicolor images are simultaneously transferred onto the recording sheet which is appropriately placed.

Subsequently, the recording sheet is subjected to charge elimination employing separation brush (in the separation unit) 19 which is brought into pressure contact at almost the same time when the transfer roller is brought into pressure contact, is separated from the circumferential surface of the photoreceptor drum 11, is conveyed to a fixing unit 20, is subjected to melt adhesion of the toner which is heated and pressed by heating roller 201 and pressure roller 202, and is then ejected to the exterior of the apparatus via paper ejecting roller 21. Incidentally, the above-mentioned transfer roller 18 and the separation brush 19, after passing the recording sheet P, withdraw from the circumferential surface of the photoreceptor drum 11 and are prepared for the subsequent formation of a new toner image.

On the other hand, the photoreceptor drum 11, from which the recording sheet P has been separated, is subjected to removal and cleaning of the residual toner through pressure contact of the blade 221 of cleaning unit 22, is again subjected to charge elimination employing the exposure section 23, subjected to recharging employing the charging unit 12, and subjected to a subsequent image forming process. Further, when color images are formed upon being superimposed on the photoreceptor, the above-mentioned blade 221 and brush roller 222 are immediately withdrawn after cleaning the photoreceptor surface of the photoreceptor drum.

Paper such as usual paper, neutralized paper, acidic paper plastic support such as polyester base are generally employed for the recording sheet P, and any support which can fix toner image thereon may be employed for the recording sheet.

Further, reference numeral 30 is a detachable cartridge in which a photoreceptor, a transfer unit, a separation unit, and a cleaning unit are integrated.

The electrophotographic image forming apparatus is constituted in such a manner that components such as the above-mentioned photoreceptor, development unit, cleaning unit the like are integrated as a cartridge, and this unit may be detachable from the main body. Further, the process cartridge may be formed as a single detachable unit in such a manner that at least one of a charging unit, an image exposure unit, a development unit, a transfer or separation unit, and a cleaning unit is integrated with a photoreceptor, and it may be arranged to be detachable employing an guiding means such as a rail in the apparatus main body.

When an image forming apparatus is employed as a copier or a printer, image exposure is carried out in such a manner that light reflected from an original document or a light transmitted through it is irradiated onto a photoreceptor, or an original document is read employing a sensor, said read information is converted into signals, and a laser beam scanning corresponding to the resulting signals, driving a LED array, and driving a liquid crystal shutter array are carried out and light is irradiated onto the photoreceptor.

Further, when employed as the printer of a facsimile machine, the image exposure unit 13 is employed so as to carry out exposure to print received data.

The electrophotographic photoreceptor of the present invention may generally be applied to electrophotographic apparatuses such as copiers, laser printers, LED printers, liquid crystal shutter printers, etc. In addition, it may widely be applied to apparatuses for display, recording, offset printing, plate making, facsimile, to which electrophotographic techniques are applied.

EXAMPLES

A photoreceptor was prepared in the following manner.

Preparation of Photoreceptor 1

| <Inter layer> | |
|---|---|
| Polyamide resin (Amilan CM-8000, manufactured by Toray Co., Ltd.) | 60 g |
| Methanol | 1600 ml |
| 1-butanol | 400 ml |

The above mentioned components are mixed and dissolved to prepare an interlayer coating liquid. The coating layer was coated by an immersion coating method on a cylindrical aluminum substrate having a diameter of 80 mm and a length of 360 mm so as to form an interlayer having a thickness of 0.3 $\mu$m.

| <Charge generation layer> | |
|---|---|
| Titanylphthalocyanine | 60 g |
| Silicone resin solution (15% xylene-butanol solution of KR5240, manufactured by Shin'etsu Kagaku Co., Ltd.) | 700 g |
| 2-butanone | 2000 ml |

The above-mentioned components were mixed and dispersed for 10 hours using a sand mill to prepare a charge generation layer coating liquid. The coating liquid was coated of the interlayer by an immersion method so as to form a charge generation layer having a thickness of 0.2 $\mu$m. The X-ray diffraction spectrum of titanylphthalocyanine was measured, and the maximum peak was found at a Bragg's angle 2θ of 27.7°.

| <Charge transport layer> | |
|---|---|
| 4-methoxy-4'-(4-methyl-α-phenylstyryl)triphenylamine | 200 g |
| Bisphenol Z type polycarbonate (IUPILON Z-300, manufactured by Mitsubishi Gas Kagaku Co., Ltd.) | 300 g |
| 1,2-dichloroethane | 2000 ml |

The above-mentioned components were mixed and dissolved to prepare a charge transport layer coating liquid. The coating liquid was coated on the foregoing charge generation layer by an immersion coating method to form a charge transport layer having a thickness of 25 μm.

| <Resin layer> | |
|---|---|
| Trimethoxymethylsilane | 180 g |
| 1-butanol | 280 ml |
| 1% acetic acid aqueous solution | 106 ml |

The above-mentioned components were mixed and stirred for 2 hours at 60° C., and 370 ml of 1-butanol was added to the mixture and further stirred for 48 hours.

To the liquid, 67.5 g of dihydroxymethyltriphenylamine (exemplified compound T-1), 1.7 g of antioxidant Sanol LS2626, manufactured by Sankyo Co., Ltd., and 4.5 g of dibutyl stannous acetate were added and mixed. Thus obtained liquid was coated to form a resin layer having a dry thickness of 1 μm and hardened for 1 hour at 120° C., to prepare Photoreceptor 1 to be used in example.

Preparation of Photoreceptor 2

Photoreceptor 2 was prepared in the same manner as in Photoreceptor 1 except that dihydroxymethyltriphenylamine was replaced by 4-[2-(triethoxysilyl)ethyl]triphenylamine.

Preparation of Photoreceptor 3

The interlayer, the charge generation layer and the charge transport layer were prepared in the same manner as in Photoreceptor 1.

| <Resin layer> | |
|---|---|
| Trimethoxymethylsilane | 120 g |
| γ-glycidoxypropyltrimethoxysilane | 60 g |
| 1-butanol | 280 ml |
| 1% acetic acid aqueous solution | 106 ml |

The above-mentioned components were mixed and stirred for 2 hours at 60° C. Then 370 ml of 1-butanol was added to the liquid and the mixture was further stirred for 48 hours.

To the liquid, 60 g of exemplified compound S-2, 10 g of fine particle of PTFE, Lubron L2, manufactured by Daikin Kogyo Co., Ltd., having an average diameter of 0.2 μm and 4.5 g of dibutyl stannous acetate were added and stirred. Thus obtained liquid was coated so as to form a resin layer having a thickness of 1 Jum. The coated layer was subjected to hardening treatment by heating for 1 hour at 120° C. to prepare Photoreceptor 3.

Preparation of Photoreceptor 4

The interlayer, the charge generation layer and the charge transport layer were prepared in the same manner as in Photoreceptor 1.

| <Resin layer> | |
|---|---|
| Trimethoxymethylsilane | 120 g |
| γ-glycidoxypropyltrimethoxysilane | 60 g |
| 1-butanol | 280 ml |
| 1% acetic acid aqueous solution | 106 ml |

The above-mentioned components were mixed and stirred for 2 hours at 60° C. Then 370 ml of 1-butanol was added to the liquid and the mixture was further stirred for 48 hours.

To the liquid, 60 g of exemplified compound H-1, 10 g of fine particle of PTFE, Lubron L2, manufactured by Daikin Kogyo Co., Ltd., having an average diameter of 0.2 μm and 100 g of colloidal silica (methanol suspension having a solid content of 30%) were added and stirred. Thus obtained liquid was coated so as to form a resin layer having a thickness of 1 μm. The coated layer was subjected to hardening treatment by heating for 1 hour at 120° C. to prepare Photoreceptor 4.

Preparation of Photoreceptor 5

Photoreceptor 5 was prepared in the same manner as in Photoreceptor 1 except that hydroxymethyltriphenylamine (exemplified compound T-1) in the resin layer was omitted.

Preparation of Photoreceptor 6

Photoreceptor 6 was prepared in the same manner as in Photoreceptor 1 except that the resin layer was omitted.

Preparation of Photoreceptor 7

Photoreceptor 7 was prepared in the same manner as in Photoreceptor 1 except that the antioxidant in the resin layer was omitted.

Example (20 Examples in All)

The photoreceptor prepared as above-mentioned were each installed in a digital copy machine Konica 7050, manufactured by Konica Corporation. The copy machine has a laser exposure process and a reverse developing process and the cleaning means was set as follows.

A cleaning blade having a rubber hardness of 70° according to JIS A, a repulsion elasticity of 30%, a thickness of 2 mm, and a free length of 9 mm, was touched to the photoreceptor in the counter direction of the rotation direction of the photoreceptor with a touching angle of 20° and a pressure of 20 g/cm.

A brush roller constituted by providing an electroconductive acryl brush around a core shaft of SUS having a diameter of 6 mm so that the diameter of the brush was 15 mm was installed below the blade so as to encroach for 1 mm. The thickness of the single filament and the filament density of the brush were each 15 denier and $9.3\times10^2$ f/cm$^2$, respectively. The brush roller was set so as to rotate at a rotating speed of 500 rpm synchronously with the photoreceptor in the same direction. A flicker for removing the toner from the brush was attached so as to encroach by 1 mm into the brush.

Practical copying test was carried out at 30° C. and 80% RH by 50,000 copies to evaluate the quality of the copied image. Results are shown in Table 1.

TABLE 1

| Example No. | Photo-receptor No. | Brush roller Material | Single filament thickness (D) | Filament density ($10^2$f/cm$^2$) | Effective driving torque (kgf · cm) | Blade Pressure (g/cm) | Image quality Density | Fog | Occurrence of insufficient cleaning | Remarks |
|---|---|---|---|---|---|---|---|---|---|---|
| 1 | 1 | Acryl | 15.0 | 9.3 | 0.72 | 20 | A | A | B | Inv. |
| 2 | 1 | Acryl | 6.2 | 9.3 | 0.41 | 20 | B | B | A | Inv. |
| 3 | 1 | Rayon | 29.0 | 7.0 | 1.85 | 20 | B | A | B | Inv. |
| 4 | 1 | p.p | 8.5 | 11.6 | 1.30 | 20 | B | B | B | Inv. |
| 5 | 1 | Nylon | 10.0 | 10.9 | 1.45 | 20 | B | B | B | Inv. |
| 6 | 2 | Acryl | 15.0 | 9.3 | 0.72 | 20 | B | B | B | Inv. |
| 7 | 3 | Acryl | 15.0 | 9.3 | 0.42 | 20 | A | A | B | Inv. |
| 8 | 4 | Acryl | 15.0 | 9.3 | 0.45 | 20 | A | A | A | Inv. |
| 9 | 1 | Acryl | 15.0 | 9.3 | 0.72 | 28 | A | A | B | Inv. |
| 10 | 1 | Acryl | 15.0 | 9.3 | 0.72 | 6 | B | B | B | Inv. |
| 11 | 7 | Acryl | 15.0 | 9.3 | 0.72 | 20 | B | B | B | Inv. |
| 12 | 5 | Acryl | 15.0 | 9.3 | 0.86 | 20 | C | D | B | No inv. |
| 13 | 6 | Acryl | 15.0 | 9.3 | 0.77 | 20 | B | D | D | No inv. |
| 14 | 6 | Rayon | 29.0 | 7.0 | 1.86 | 20 | C | D | D | No inv. |
| 15 | 1 | Acryl | 5.0 | 9.3 | 0.37 | 20 | B | B | C | Inv. |
| 16 | 1 | Acryl | 6.2 | 4.0 | 0.08 | 20 | C | C | D | No inv. |
| 17 | 1 | Rayon | 33.0 | 9.3 | 2.14 | 20 | C | B | D | No inv. |
| 18 | 1 | Acryl | 15.0 | 16.5 | 2.04 | 20 | C | B | D | No inv. |
| 19 | 1 | Acryl | 15.0 | 9.3 | 0.72 | 35 | C | B | B | Inv. |
| 20 | 1 | Acryl | 15.0 | 9.3 | 0.72 | 4 | B | C | B | Inv. |

The evaluation was performed by taking 50,000 copies of an original image, having a pixel ratio of 7%, including a character, a portrait photograph, a solid white image and a solid black image. The size of image was A4 and the copy was carried out in an interval mode. The quality of solid white image, solid black image and occurrence of insufficient cleaning were evaluated on every 1,000 copies. The occurrence of insufficient cleaning was evaluate by the number of copy on which 5 or more white spots having a diameter of 0.3 mm or more were formed in the solid black image. Regarding the image density, the absolute reflective density was measured by a densitometer RD-918 manufactured by Macbeth Co., Ltd., and the density of the initial copy and that of the 50,000th copy were compared. Regarding the fogging, the fog in the solid white image was visually evaluated on the initial copy and the 50,000th copy.

The turn over of the blade was evaluated by the number of occurrence of turn over in the course 50,000 copies.

Image density

A: Not less than 1.2: Good

B: From less than 1.2 to 0.8 : acceptable for practical use

C: Less than 0.8 : Not acceptable for practical use

Fog

A: No fogging

B: Slightly foggy (acceptable for practical use).

C: Fog was occurred at times.

D: Fog was occurred continuously.

Occurrence of insufficient cleaning

A: No white spot

B: Number of copy having white spots was not more than 5 per 50,000 copies.

C: Number of copy having white spots was within the range of from 6 to 20 per 50,000 copies.

D: Number of copy having white spots was 21 or more per 50,000 copies.

Table 1 shows that though image quality such as density, fog and cleaning characteristics is favorable at the time of measurement, wearing amount of the photoreceptor surface was 3.75 $\mu$m, which was much greater than those of samples of the invention I. 1 to I. 9, as the conventional photoreceptor No. 6 containing polycarbonate in the surface layer was cleaned by a blade and cleaning brush in sample C. 10. This means that the photoreceptor was affected markedly in spite of employing brush which does not relatively affect so much to the photoreceptor and selecting lower torque. It is expected that the surf ace of the photoreceptor would abraded further along with long time using, and harmful affects would be give to the image quality as the result. It also suggests that control of image quality is difficult by employing simply blade and brush roller.

Though characteristics of brush or torque were further modified in samples C. 2 and C. 3, it is demonstrated that they affected adversely to image quality. The wearing amount of the photoreceptor was very large as 6.23 and 11.57 at that time.

The same photoreceptor as sample I. 1 was employed in the samples C. 4, 5, 6, 7, 8 and 9. However adverse affects was found in image quality as the condition of brush or blade was outside of the invention. In Sample C. 1 structural unit having charge transportability at the surface layer was removed from sample I. 1. Image quality problem appeared in this sample.

Control of cleaning means as well as photoreceptor is difficult for obtaining good image quality. Preferable image was obtained in 50,000 sheets printing test at high temperature and high moisture condition for samples I. 1 to I. 11. It demonstrates that excellent image can be stably obtained by combining species of photoreceptor and condition of cleaning blade and brush roll condition suitably.

ADVANTAGE OF THE INVENTION

The electrophotographic image forming method, electrophotographic image forming apparatus, and the processing cartridge and electrophotographic photoreceptor to be used in the apparatus can be provide by the constitution of the combination of the photoreceptor and the cleaning means according to the invention, by which a copy image having a high durability and quality can be obtained under a high temperature and high humid condition.

EXPLANATION OF CODE

Figure 1:
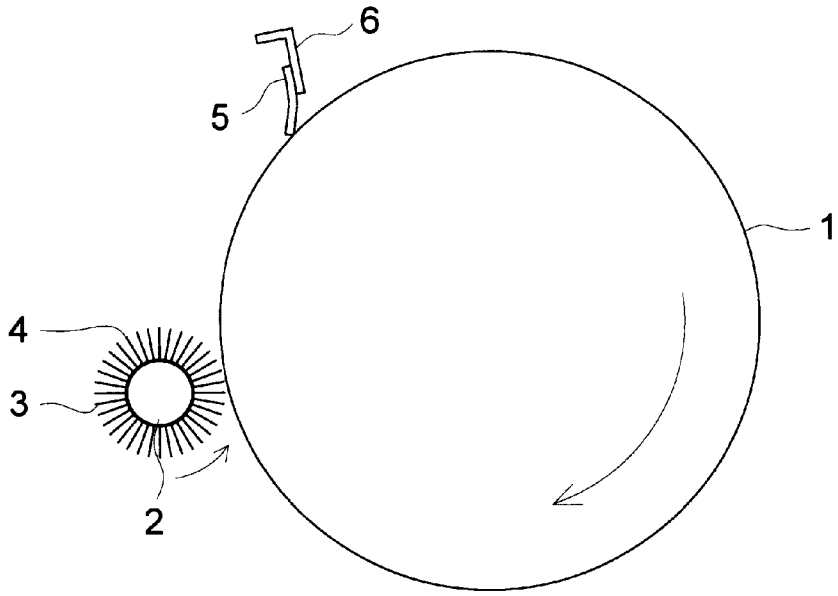
FIG. 1 shows the structures of an organic photoreceptor, a brush roller and an elastic rubber roller according to the invention.
Figure 2:
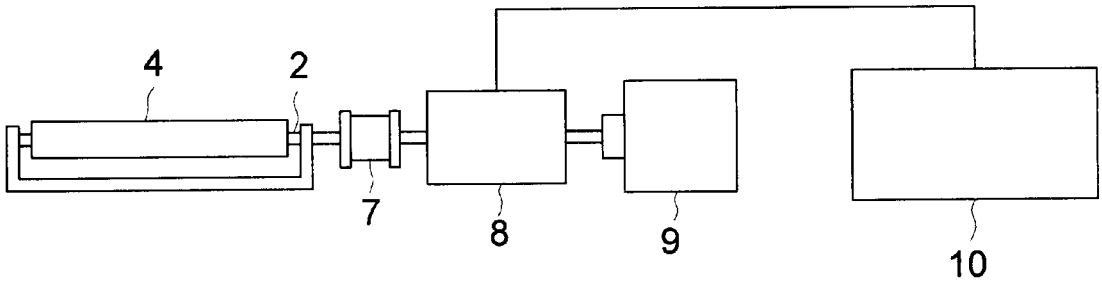
FIG. 2 shows the schematic drawing of the apparatus used for measuring the torque.
Figure 3:
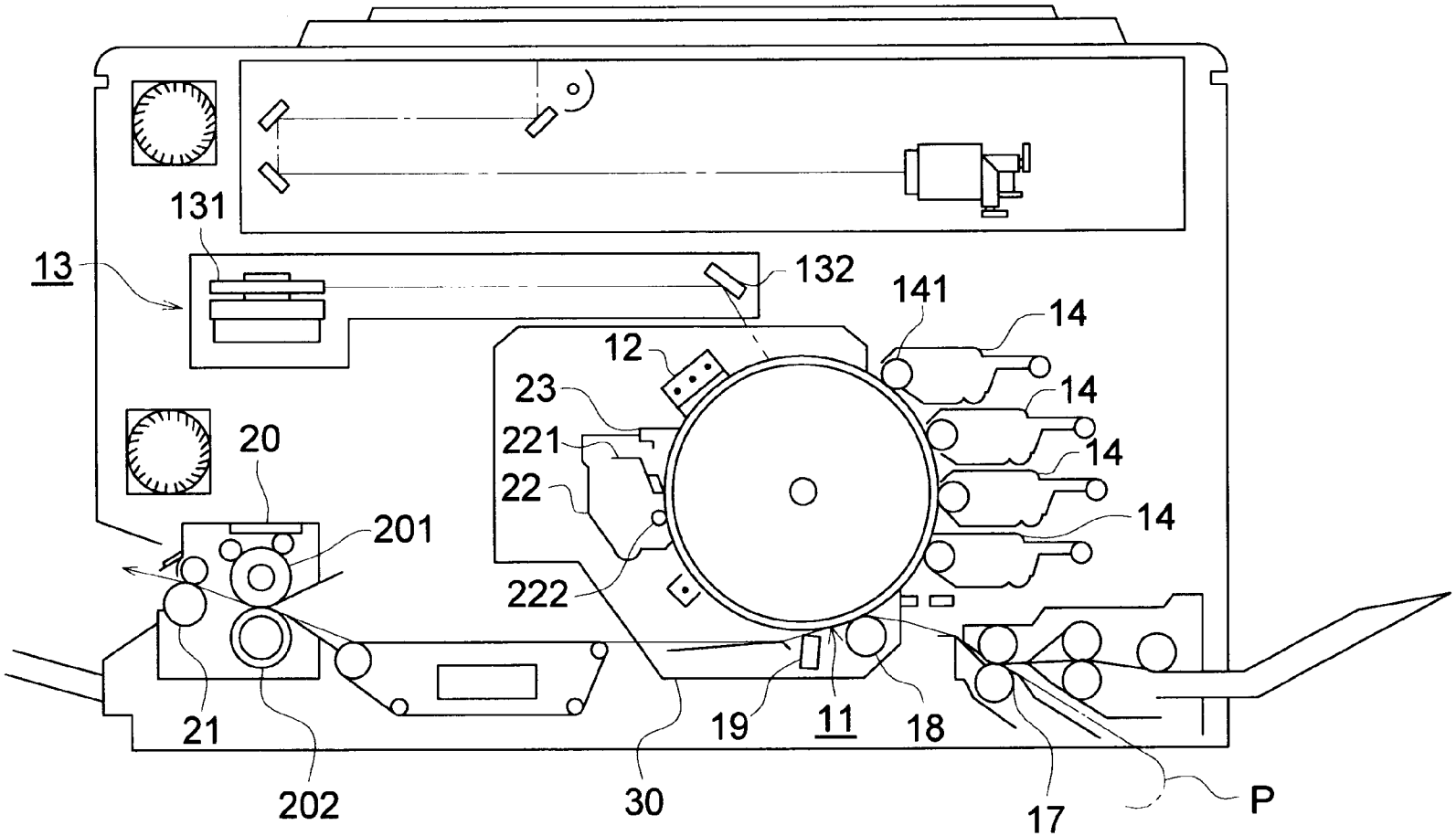
FIG. 3 shows an example of image forming image forming apparatus having an electrophotographic photoreceptor according to the invention.

1: Organic photoreceptor
2: Cylindrical brush support
3: Adhesive layer
4: Brush roller
5: Elastic rubber blade
6: Support member
11: Photoreceptor drum (or photoreceptor)
12: Charger
13: Image exposure device
14: Developing device
17: Paper supplying roller
18: Transfer roller (transfer devoce)
19: Separating brush (separating device)
20: Fixing apparatus
21: Paper ejecting roller
22: Cleaning device
23: Exposure section employing light emission diode etc.

What is claimed is:

1. An electrophotographic image forming method comprising the step of cleaning a toner remained on an electrophotographic photoreceptor by a brush roller and an elastic rubber blade after transferring a toner image formed on the electrophotographic photoreceptor to an image receiving material, wherein the photoreceptor has a resin layer comprising a siloxane resin having an electric charge transportable structural unit and a cross-linked structure, the thickness of the single filament is from 6 denier to 30 denier and the density of the filament of the brush roller is from $4.5\times10^2$ to $15.5\times10^2$ f/cm$^2$ (number of filament per square centimeter), and the pressure of the elastic rubber blade to the photoreceptor surface is from 5 to 30 g/cm.

2. The electrophotographic image forming method of claim 1 wherein the electric charge transportable structural unit having the following structure is in the structure of the siloxane resin.

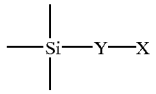

wherein X is a structural unit having an electric charge transport ability and bonded with Y through a carbon atom or a silicon atom constituting the structural unit, Y is a group of two or more atoms or groups without the adjacent bonding atom (Si and C).

3. The electrophotographic image forming method of claim 2 wherein Y is an oxygen atom, a sulfur atom or an NR group, wherein R is a hydrogen atom or a monovalent organic group.

4. The electrophotographic image forming method of claim 1 wherein the resin layer is a layer containing a siloxane resin having a cross-linked structure and a structural unit having an electric charge transport ability which is obtained by reacting an organic silicon compound having a hydroxyl group or a hydrolyzable group with an electric charge transportable compound having a hydroxyl group.

5. The electrophotographic image forming method of claim 1 wherein the resin layer contains an organic fine particle having an average particle diameter of from 0.05 $\mu$m to 10 $\mu$m.

6. The electrophotographic image forming method of claim 5 wherein organic fine particle is a fine particle of resin containing a fluorine atom.

7. The electrophotographic image forming method of claim 1 wherein the resin layer contains colloidal silica.

8. The electrophotographic image forming method of claim 1 wherein the brush roller has an electroconductive brush.

9. The electrophotographic image forming method of claim 1 wherein the brush of the brush roller is a hydrophobic high molecular weight polymer capable of forming a filament having a high dielectric constant.

10. The electrophotographic image forming method of claim 1 wherein the brush of the brush roller is made by an acrylic resin.

11. The electrophotographic image forming method of claim 1 wherein the brush roller rotates synchronously with the photoreceptor in the same direction.

12. The electrophotographic image forming method of claim 1 wherein the brush roller rotates with the photoreceptor so that the brush contacting the photoreceptor moves toward the elastic rubber blade.

13. The electrophotographic image forming method of claim 1, wherein the photoreceptor has a photosensitive layer and the resin layer comprising a siloxane resin having an electric charge transportable structural unit and a cross-linked structure provided as another layer on the photosensitive layer.

14. An electrophotographic image forming method comprising the step of cleaning a toner remained on an electrophotographic photoreceptor by a brush roller and an elastic rubber blade after transferring a toner image formed on the electrophotographic photoreceptor to an image receiving material wherein the photoreceptor has a resin layer comprising a siloxane resin having an electric charge transportable structural unit and a cross-linked structure, wherein the toner is cleaned by a brush roller touched to the photoreceptor under a condition of an effective driving torque of from 0.1 kgf·cm to 2.0 kgf·cm and an elastic rubber blade touched to the photoreceptor surface with a pressure of from 5 to 30 g/cm.

Effective driving torque: T=T1−T2

T1: The driving torque of the brush roller when of the brush roller is touched to the photoreceptor T2: The driving torque of the brush roller when of the brush roller is not touched to the photoreceptor.

15. The electrophotographic image forming method of claim 14 wherein the thickness of the single filament is from 6 denier to 30 denier and the density of the filament of the brush roller it from $4.5\times10^2$ to $15.5\times10^2$ f/cm$^2$ (number of filament per square centimeter).

16. The electrophotographic image forming method of claim 14 wherein the electric charge transportable structural unit has the following structure

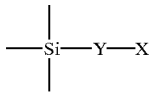

wherein X is a structural unit having electric charge transportability and bonded to Y through a carbon atom or a silicon atom constituting the structural unit, Y is a group of two or more atoms or groups in addition to Si or C bonding atom.

17. The electrophotographic image forming method of claim 14 wherein the resin layer is a layer containing a siloxane resin having a crosslinked structure and a structural unit having an electric charge transportability which is obtained by reacting an organic silicon compound having a hydroxyl group or a hydrolyzable group with an electric charge transportable compound having a hydroxyl group.

18. The electrophotographic image forming method of claim 14 wherein the brush roller has an electroconductive brush.

19. The electrophotographic image forming method of claim 14 wherein the brush of the brush roller is a hydrophobic high molecular weight polymer capable of forming a filament having a high dielectric constant.

20. The electrophotographic image forming method of claim 14 wherein the brush of the brush roller is made by an acrylic resin.

21. The electrophotographic image forming method of claim 14 wherein the brush roller rotates synchronously with the photoreceptor in the same direction.

22. The electrophotographic image forming method of claim 14 wherein the brush roller rotates with the photoreceptor so that the brush contacting the photoreceptor moves toward the elastic rubber blade.

23. An electrophotographic image forming apparatus having a cleaning means for removing a toner remained on the electrophotographic photoreceptor thereof for repeatedly forming images wherein the photoreceptor comprises a siloxane resin containing a structural unit having an electric charge transport ability and a cross-linked structure, and the toner remained on the photoreceptor is removed by a brush roller having a thickness of single filament of from 6 to 30 denier and the density of the filament of from $4.5\times10^2$ to 15.5 f/cm$^2$ (number of filament per square centimeter) and an elastic rubber blade pressed to the surface of the photoreceptor with a pressure of from 5 to 30 g/cm.

24. An electrophotographic image forming apparatus having a cleaning means for removing a toner remained on the electrophotographic photoreceptor thereof for repeatedly forming images wherein the photoreceptor comprises a siloxane resin containing a structural unit having an electric charge transport ability and a cross-linked structure, and the toner remained on the photoreceptor is removed by a brush roller touched to the photoreceptor under a condition of an effective driving torque of from 0.1 kgf·cm to 2.0 kgf·cm and an elastic rubber blade pressed to the surface of the photoreceptor with a pressure of from 5 to 30 g/cm.

Effective driving torque: T=T1−T2

T1: The driving torque of the brush roller when of the brush roller is touched to the photoreceptor

T2: The driving torque of the brush roller when of the brush roller is not touched the photoreceptor.

25. A processing cartridge to be used in an electrophotographic image forming apparatus having a cleaning means for removing a toner remained on the electrophotographic photoreceptor thereof, in which the photographic photoreceptor having a resin layer comprising a siloxane resin having a structural unit having an electric charge transport ability and a cross-linked structure, and a cleaning means including a brush roller having a filament having a single filament thickness of from 6 to 30 denier and a filament density of $4.5\times10^2$ to 15.5 f/cm$^2$ (filament number per square centimeter) and an elastic rubber blade touched to the photoreceptor surface with a pressure of from 5 to 30 g/cm, are built up to one unit designed so as to be capable of putting onto and taking off from the apparatus.

* * * * *